US007451573B2

(12) United States Patent
Orszulak et al.

(10) Patent No.: US 7,451,573 B2
(45) **Date of Patent: *Nov. 18, 2008**

(54) SLOTTED M-TRACK BEAM STRUCTURES AND RELATED WALL ASSEMBLIES

(76) Inventors: Leszek Orszulak, 3354 S. 300th Pl., Auburn, WA (US) 98001; Jaroslaw Sydry, 29901 114th Way SE., Auburn, WA (US) 98092

( * ) Notice: Subject to any disclaimer, the term of this patent is extended or adjusted under 35 U.S.C. 154(b) by 459 days.

This patent is subject to a terminal disclaimer.

(21) Appl. No.: 11/067,333

(22) Filed: Feb. 25, 2005

(65) Prior Publication Data

US 2006/0191227 A1 Aug. 31, 2006

(51) Int. Cl.
*E04B 2/76* (2006.01)
*E04B 1/343* (2006.01)
*E04B 1/38* (2006.01)

(52) U.S. Cl. ..... 52/167.1; 52/241; 52/481.1; 52/573.1

(58) Field of Classification Search ..... 52/241, 52/481.1, 481.2, 573.1, 167.1, 731.5, 731.1, 52/731.7, 731.8, 731.9, 733.2; D25/61, 131
See application file for complete search history.

(56) References Cited

U.S. PATENT DOCUMENTS

| | | | | | |
|---|---|---|---|---|---|
| 2,105,771 | A * | 1/1938 | Holdsworth | 52/290 |
| 2,245,644 | A * | 6/1941 | Braloff | 52/241 |
| 3,423,893 | A * | 1/1969 | Marx | 52/241 |
| 3,950,912 | A * | 4/1976 | Lundberg et al. | 52/733.2 |
| 4,058,951 | A * | 11/1977 | Dean | 52/656.1 |
| 4,064,996 | A * | 12/1977 | Shillum | 211/191 |
| 5,127,760 | A * | 7/1992 | Brady | 403/430 |
| 5,619,837 | A * | 4/1997 | DiSanto | 52/798.1 |
| 5,647,186 | A * | 7/1997 | Donaldson | 52/653.1 |
| 5,720,138 | A * | 2/1998 | Johnson | 52/220.7 |
| 6,381,916 | B1 * | 5/2002 | Maisch et al. | 52/736.1 |
| 6,557,254 | B1 * | 5/2003 | Johnson | 29/897.312 |
| 6,748,705 | B2 * | 6/2004 | Orszulak et al. | 52/167.1 |
| 6,854,237 | B2 * | 2/2005 | Surowiecki | 52/633 |
| 2001/0004825 | A1 * | 6/2001 | Menendez | 52/736.1 |
| 2006/0032157 | A1 * | 2/2006 | Baryla et al. | 52/167.1 |
| 2007/0125026 | A1 * | 6/2007 | Frobosilo | 52/481.1 |
| 2007/0193187 | A1 * | 8/2007 | O'Connor | 52/653.1 |

* cited by examiner

*Primary Examiner*—Robert Canfield
(74) *Attorney, Agent, or Firm*—Thomas E. Loop

(57) ABSTRACT

A slotted M-track or building wall support structure generally characterized by a metal M-shaped channel beam member is disclosed. The M-shaped channel beam member is defined by a pair of elongated confronting sidewalls integrally connected to an open end of an elongated and generally V-shaped stud receiving track. The V-shaped stud receiving track is positioned between the pair of confronting sidewalls and a pair of elongated and spaced apart coplanar legs. The legs are perpendicularly connected to the sidewalls and to the open end of the generally V-shaped stud receiving track. The V-shaped stud receiving track includes a plurality of longitudinally spaced slots, with each slot sized and configured to receive a stud.

1 Claim, 3 Drawing Sheets

SLOTTED M-TRACK BEAM STRUCTURES AND RELATED WALL ASSEMBLIES

TECHNICAL FIELD

The present invention relates generally to structural building wall construction and, more particularly, to dynamic head-of-wall metal header beam structures and related wall assemblies.

BACKGROUND OF THE INVENTION

Interior wall construction systems using horizontal channel shaped beams as headers and footers together with manually fastened vertical studs is generally known. In common practice, the channel beams and studs of such systems are made of formed metal, typically steel.

An advantage of steel wall construction is not only strength, but also ease of assembly. For example, steel studs may be readily positioned into opposing steel footer and header channel beams (also sometimes referred to as tracks or runners) by means of retaining devices in one or both of the beams. Examples of such steel wall constructions may be found in U.S. Pat. Nos. 4,854,096 and 4,805,364 both to Smolik.

Steel wall constructions may also be configured to allow building movement such as during a seismic event without damage to the wall. In this regard, full-height non-bearing walls configured to accommodate vertical ceiling movement are known (e.g., dynamic head-of-wall systems), and are commonly installed beneath overhead structural members such as roof beams, floor beams, and the like. Examples of these types of steel wall constructions may be found in U.S. Pat. No. 5,127,203 to Paquette and U.S. Pat. No. 5,127,760 to Brady. In these exemplary steel wall assemblies a stud is vertically positioned within the header channel beam at a vertically aligned slot and a screw is inserted through the slot and into the stud. In these type of configurations, and upon movement of the building and/or overhead structural member (e.g., during an earthquake), the studs are able to slide vertically in the header channel beam as the screws slide in the slots (thereby preventing the drywall from cracking during earthquakes by permitting the wallboard to move up and down).

A disadvantage of these prior art approaches is that each screw must be precisely installed by a tradesman standing on a stool or ladder, which is both time-consuming and expensive. The fastening screw must not be installed too tight such that it could bind and prevent the sliding motion of the stud within the channel beam. The screw must also not be installed too loose such that it protrudes and inhibits subsequent wallboard installation.

Because of these shortcomings and others inherent to known steel wall assemblies and dynamic head-of-wall systems, there is still a need in the art for new and improved wall assemblies, especially wall header beams or tracks and related wall assemblies that accommodate vertical header channel beam movement relative to a plurality of fixed studs. The present invention fulfills these needs and provides for further related advantages.

BRIEF DESCRIPTION OF THE DRAWINGS

The drawings are intended to be illustrative and symbolic representations of certain exemplary embodiments of the present invention and as such they are not necessarily drawn to scale. In addition, it is to be expressly understood that the relative dimensions and distances depicted in the drawings are exemplary and may be varied in numerous ways. Finally, like reference numerals have been used to designate like features throughout the several views of the drawings.

SUMMARY OF THE INVENTION

Figure 1:
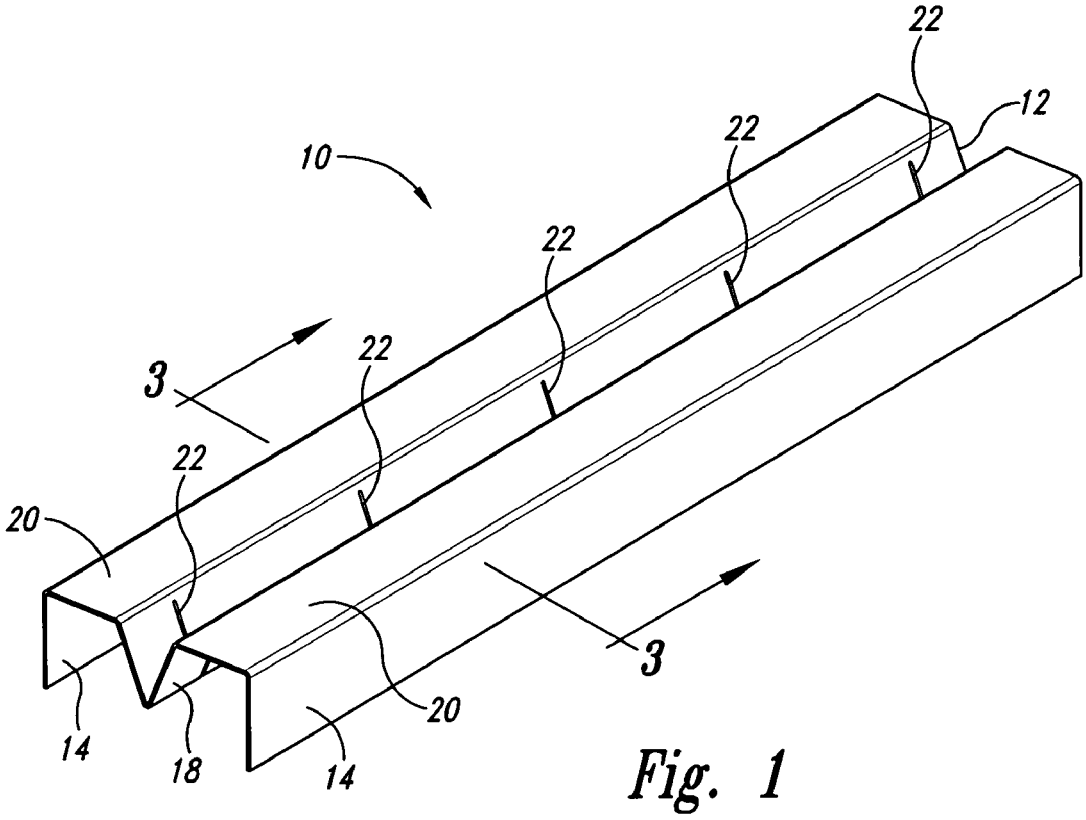
FIG. 1 is a perspective view of a slotted M-track in accordance with an embodiment of the present invention.
Figure 2:
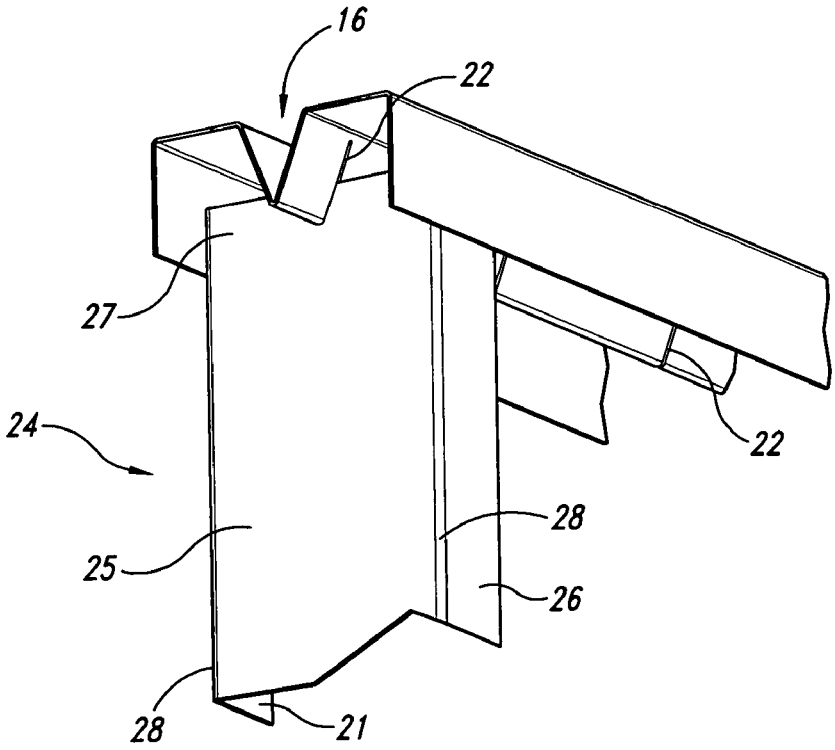
FIG. 2 is a fragmentary perspective view of a slotted M-track together with a stud in accordance with an embodiment of the present invention. The slotted M-track is shown with a stud engaged in one of a plurality of longitudinally spaced elongated stud receiving slots.

In one embodiment, the present invention is directed to a slotted M-track or building wall header beam support structure generally characterized by a M-shaped channel beam or track member (as viewed in cross-section). In this embodiment, the M-shaped channel beam member is defined by a pair of elongated confronting sidewalls integrally connected to an open end of an elongated and generally V-shaped slotted stud receiving track by a pair of elongated and spaced apart legs. The V-shaped stud receiving track is positioned between the pair of confronting sidewalls and the pair of elongated and spaced apart legs. The legs are perpendicularly connected to the sidewalls and to the open end of the generally V-shaped stud receiving track. The V-shaped stud receiving track includes a plurality of longitudinally spaced elongated slots, with each slot sized and configured to receive an upper end portion of a stud. More broadly stated, the present invention is directed to a building wall beam structure comprising an elongated channel member having a generally M-shaped cross-sectional contour.

In another embodiment, the present invention is directed to a slotted M-track generally characterized by a U-shaped header beam or track member in which a slotted V-shaped channel has been fastened to the underneath portion of the web and/or confronting sidewalls of the U-shaped channel. In this embodiment, the slotted V-shaped channel is preferably defined as a plurality of single slotted V-shaped clips (that are individually fastened along the underneath portion of the web and/or confronting sidewalls of the U-shaped channel).

In yet another embodiment, the present invention is directed to a structural wall assembly configured to accommodate vertical beam movement relative to a plurality of engaged studs. In this embodiment, the structural wall assembly includes: an elongated sheet-metal channel shaped footer beam (or track); an elongated sheet-metal slotted M-track header beam (vertically spaced apart and confronting the footer track); and a plurality of sheet-metal studs (having upper and lower end portions) vertically positioned between the footer and header beams (or tracks). The slotted M-track header beam (or track) is defined by a pair of elongated confronting sidewalls integrally connected to an open end of an elongated and generally V-shaped stud receiving track. The V-shaped stud receiving track is positioned between the pair of confronting sidewalls and a pair of elongated and spaced apart legs. The legs are perpendicularly connected to the sidewalls and to the open end of the generally V-shaped stud receiving track. The V-shaped stud receiving track includes a plurality of longitudinally spaced elongated slots, with each slot sized and configured to receive a sheet-metal stud. The studs are positioned between the confronting header and footer beams (or tracks) such that lower end portions of the studs are received into the channel shaped footer beam and upper ends portions of the studs are slidably received (or engaged) into the plurality of longitudinally spaced slots of the V-shaped stud receiving track. The upper end portions of the studs are generally spaced apart from the coplanar legs so as to define a gap.

These and other aspects of the present invention will become more evident upon reference to the following detailed description and attached drawings. It is to be understood, however, that various changes, alterations, and substitutions may be made to the specific embodiments disclosed herein without departing from their essential spirit and scope. In addition, it is to be further understood that the drawings are intended to be illustrative and symbolic representations of certain exemplary embodiments of the present invention and as such they are not necessarily drawn to scale. Finally, it is expressly provided that all of the various references cited herein are incorporated herein by reference in their entireties for all purposes.

DETAILED DESCRIPTION OF THE INVENTION

Referring to the drawings, the present invention in one embodiment is directed to a slotted M-track 10 (sometimes referred to as a building wall header beam or channel) generally characterized by an elongated M-shaped channel beam member 12. The slotted M-track is particularly useful as a header beam in dynamic head-of-wall systems. As best shown in FIGS. 1 through 4, the M-shaped channel beam member 12 is defined by a pair of elongated confronting sidewalls 14 integrally connected to an open end 16 of an elongated and generally V-shaped stud receiving track 18. The V-shaped stud receiving track 18 is positioned between the pair of confronting sidewalls 14 and a pair of elongated and spaced apart coplanar legs 20. As shown, the legs 20 are perpendicularly connected to the sidewalls 14 and to the open end 16 of the generally V-shaped stud receiving track 18. As further shown, the V-shaped stud receiving track 18 includes a plurality of longitudinally spaced elongated slots 22, with each slot 22 sized and configured to receive an upper end portion 27 of a stud 24. Each stud 24 preferably comprises an elongated sheet-metal member 25 having confronting flanges 26 positioned along the lengthwise edges 28 of the elongated sheet-metal member 25. Each slot 22 is generally perpendicularly aligned relative to each of the confronting sidewalls 14 and coplanar legs 20 of the M-shaped channel beam member 12.

Preferably, the M-shaped channel beam member 12 is made from a rectangular and elongated flat metal sheet. The flat metal sheet may in some embodiments is galvanized steel. In order to form the plurality of longitudinally spaced slots 22, the metal sheet is punched a series of times along its longitudinally axis. The slots 22 are preferably relatively narrow (e.g., 1/16 inches wide by four inches long prior to bending), perpendicular aligned relative the longitudinal axis of metal sheet, and spaced apart every four inches so as to aid the installer in laying out 12 inch, 16 inch or 24 inch centers as is common in the building wall industry. The slots 22 may, however, be spaced at other intervals such as, for example, one inch intervals so as to accommodate a wider variety of stud 22 configurations. The punched metal sheet is then preferably bent lengthwise five times with a standard sheet-metal bending machine (e.g., brake-formed or roll-formed) to thereby achieve a M-shaped cross-section; the five bends corresponding to the five interior edges 30, 32, 34, 36, 38 of the M-shaped channel beam member 12 (interior edges best shown in FIG. 3).

Figure 3:
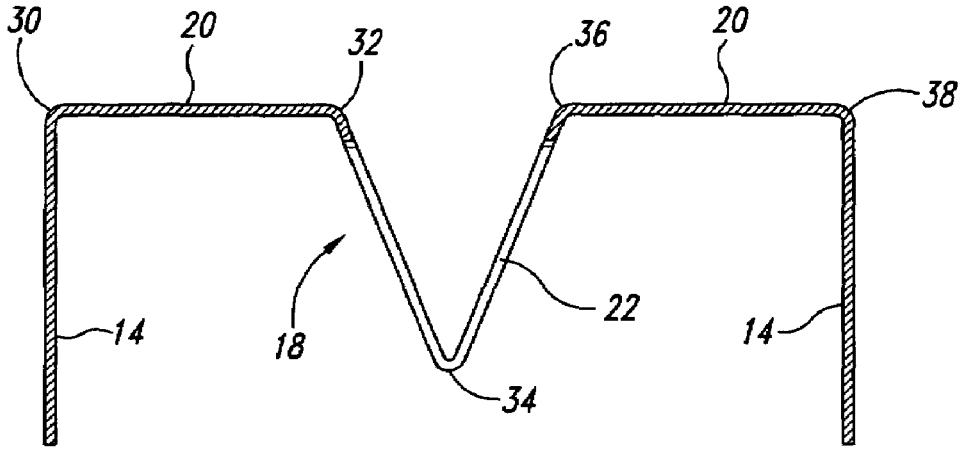
FIG. 3 is an elevational cross-sectional view taken along line 3-3 of the slotted M-track shown in FIG. 1.
Figure 4:
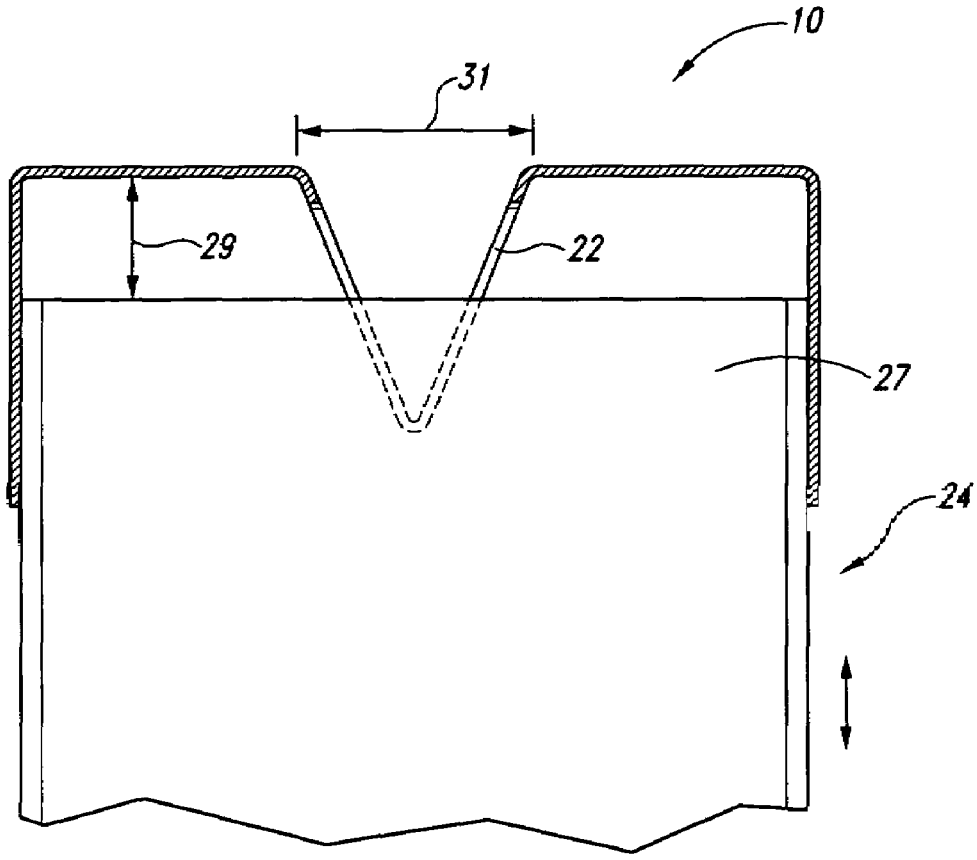
FIG. 4 is an elevational cross-sectional view taken along line 3-3 of the slotted M-track shown in FIG. 1, but shown with a stud engaged in the slot so as to define a gap between the upper end of the underneath portion of the coplanar legs of the slotted M-track.

In another embodiment (not shown), the present invention, is directed to a slotted M-track generally characterized by a standard U-shaped header beam (or track) in which a slotted V-shaped channel has been fastened to the underneath portion of the web and/or confronting sidewalls of the U-shaped channel (as shown in FIG. 3 of Applicants' earlier U.S. Pat. No. 6,748,705, which patent is incorporated herein by reference in its entirety). In this embodiment, the slotted V-shaped channel is preferably defined as a plurality of single slotted V-shaped clips (that are individually fastened along the underneath portion of the web and/or confronting sidewalls of the U-shaped channel).

The slotted M-track 10 of the present invention is generally affixed to an overhead building support structure (not shown) like, for example, steel floor pan using fasteners such as, for example, screws or shot pins. Likewise, an elongated sheet-metal channel shaped footer beam 40 (best shown in FIG. 5) is generally affixed to the floor (not shown); the channel shaped footer beam 40 is positioned such that it is aligned parallel and confronting to the slotted M-track 10. The installed slotted M-track 10 then generally receives a plurality of 16 to 20 gage steel studs 24. In this regard, an upper end portion 27 of each stud 24 is inserted into and loosely received by one of the slots 22. Preferably, the upper end portion 27 of each stud 24 is positioned about half way into the V-shaped stud receiving track 18 (or individual and spaced apart from the coplanar legs 20 (of the M-shaped channel beam member 12) so as to define a gap 29 of about ¾ inches. In this configuration, the M-shaped channel beam member 12 may be deflected either up or down a total of about 1½ inches.

The studs 24 are kept in place by the cross-sectional M-shaped configuration of the slotted M-track 10. Moreover, the cross-sectional M-shaped configuration provides structural stiffness and strength thereby anchoring each stud 24 in the horizontal direction, while the loosely received connection permits freedom of movement in the vertical direction. After placement of the studs 24 into the slots 22 of the slotted M-track 10, each stud 24 is vertically aligned and then secured to an elongated sheet-metal channel shaped footer beam 40 (best shown in FIG. 5).

The slotted M-track 10 is preferably manufactured in standard lengths of ten to twelve feet; however, the lengths may be varied to accommodate varying installation purposes. Likewise, the slotted M-track 10 is preferably manufactured to have a cross-sectional height of about 2½ inches to about 4 inches; however, these dimensions may also be varied to accommodate varying installation purposes. In addition, the slotted M-track 10 is preferably configured such that each of the spaced apart coplanar legs 20 is about ½ inch longer that the space 31 defined by the open end 16 of V-shaped stud receiving track 18. In this configuration, the installer is given a surface to support the end of the stud 22 during installation.

Figure 5:
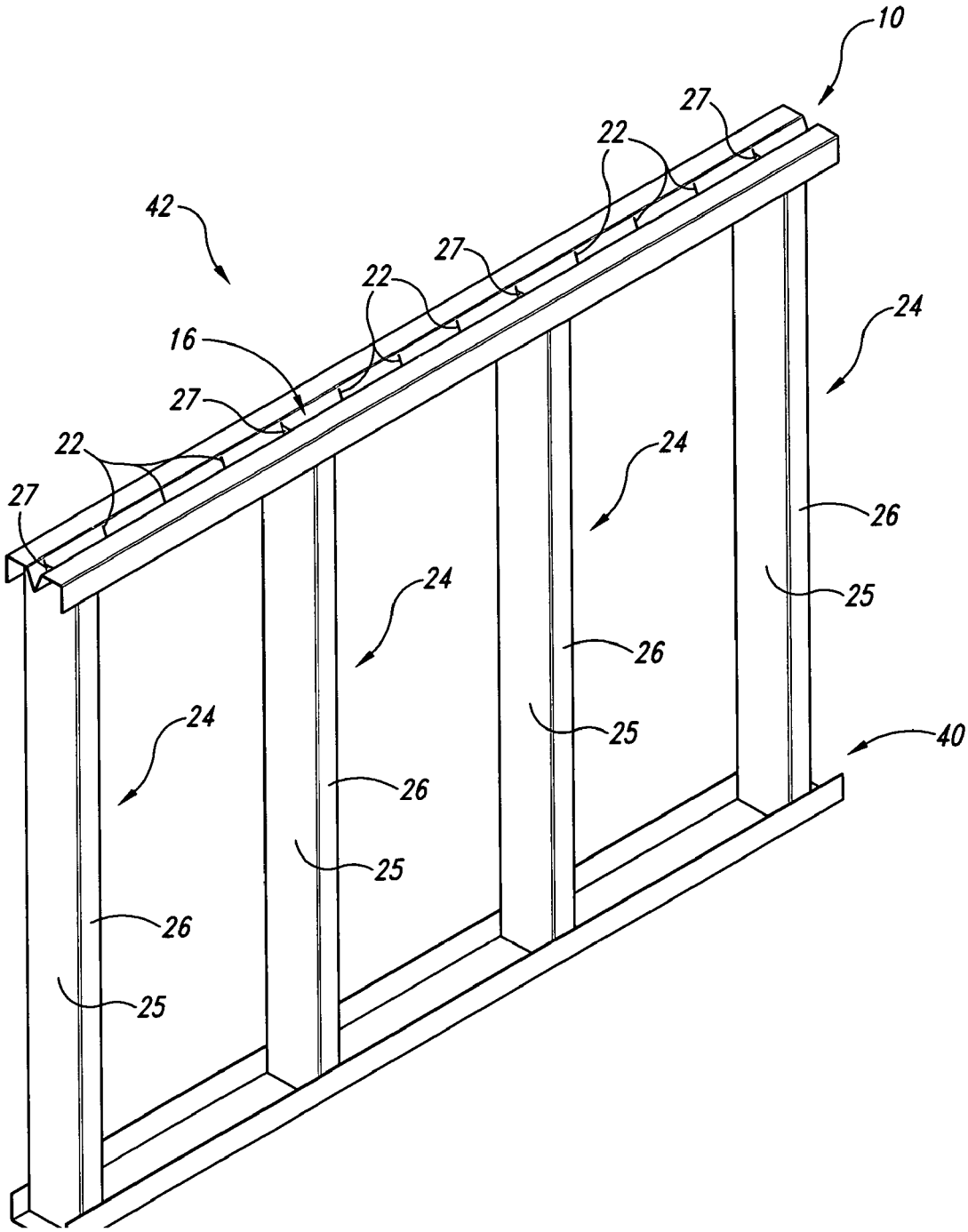
FIG. 5 is a perspective view of a structural wall assembly configured to accommodate vertical movement relative to a plurality of fixed studs in accordance with an embodiment of the present invention.

In view of the foregoing and in another embodiment as best shown in FIG. 5, the present invention is also directed to a structural wall assembly 42 configured to accommodate vertical beam movement relative to a plurality of engaged studs. In this embodiment, the structural wall assembly 42 includes: an elongated sheet-metal channel shaped footer beam 40; an elongated sheet-metal slotted M-track header beam 10 (vertically spaced apart and confronting the footer beam); and a plurality of sheet-metal studs 24 (having upper and lower ends) vertically positioned between the footer and header beams. The slotted M-track header beam 10 is defined by a pair of elongated confronting sidewalls 14 integrally connected to an open end 16 of an elongated and generally V-shaped stud receiving track 18. The V-shaped stud receiving track 18 is positioned between the pair of confronting sidewalls 14 and a pair of elongated and spaced apart coplanar legs 20. The legs 20 are perpendicularly connected to the sidewalls 14 and to the open end 16 of the generally V-shaped stud receiving track 18. The V-shaped stud receiving track 18 includes a plurality of longitudinally spaced slots 22 (or is defined by a plurality of single slotted V-shaped clips), with each slot 22 sized and configured to receive a sheet-metal stud 24. The studs 24 are positioned between the confronting header 10 and footer beams 40 such that the lower ends of the studs 24 are received into the channel shaped footer beam 40 and the upper ends 27 are slidably received into the plurality of longitudinally spaced slots 22 of the V-shaped stud receiving track 18 (or plurality of single slotted V-shaped clips). The upper ends 27 of the studs 24 are spaced apart from the coplanar legs 20 so as to define a gap 29. The size of the gap 29 determines the normal range of up and down deflection of the slotted M-track header beam 10.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions and all changes that come within the meaning and range of equivalency of the claims are to be embraced within their scope.

What is claimed is:

1. A structural wall assembly, comprising:

an elongated sheet-metal channel shaped footer beam;

an elongated sheet-metal slotted M-track header beam vertically spaced apart and confronting the footer beam, the slotted M-track header beam being defined by a pair of elongated confronting sidewalls integrally connected to an open end of an elongated and generally V-shaped stud receiving track, the V-shaped stud receiving track being positioned between the pair of confronting sidewalls and a pair of elongated and spaced apart coplanar legs, the legs being perpendicularly connected to the sidewalls and to the open end of the generally V-shaped stud receiving track, the V-shaped stud receiving track having a plurality of longitudinally spaced slots, with each slot being sized and configured to receive a sheet-metal stud; and a plurality of sheet-metal studs having upper and lower ends, the studs being vertically positioned between the spaced apart and confronting footer and header beams such that the lower ends are received into the channel shaped footer beam and the upper ends are received into the plurality of longitudinally spaced slots, the upper ends of the plurality of studs being spaced apart from the coplanar legs so as to define a gap.

* * * * *